US009463660B1

(12) United States Patent
Maresh

(10) Patent No.: US 9,463,660 B1
(45) Date of Patent: Oct. 11, 2016

(54) MULTI-COLOR MARKER

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 14/578,400

(22) Filed: Dec. 20, 2014

Related U.S. Application Data

(60) Provisional application No. 61/997,848, filed on Jun. 11, 2014.

(51) Int. Cl.

| | |
|---|---|
| ***B43K 27/04*** | (2006.01) |
| ***B43K 27/12*** | (2006.01) |
| ***B43K 8/02*** | (2006.01) |
| ***B43K 29/00*** | (2006.01) |
| ***B43K 27/08*** | (2006.01) |
| ***B43K 27/02*** | (2006.01) |

(52) U.S. Cl.
CPC ..... *B43K 27/12* (2013.01); *B43K 8/022* (2013.01); *B43K 27/02* (2013.01); *B43K 27/04* (2013.01); *B43K 27/08* (2013.01); *B43K 29/00* (2013.01)

(58) Field of Classification Search
CPC ..... B43K 27/02; B43K 27/04; B43K 27/08; B43K 27/12
USPC ..... 401/34, 35
See application file for complete search history.

(56) References Cited

U.S. PATENT DOCUMENTS

| | | | | |
|---|---|---|---|---|
| 8,011,845 | B2 * | 9/2011 | Ho | B43K 1/00 401/117 |
| 2009/0154983 | A1 * | 6/2009 | Khoshnevis | B41J 3/36 401/34 |

* cited by examiner

*Primary Examiner* — Jennifer C Chiang
(74) *Attorney, Agent, or Firm* — Nick A. Nichols, Jr.

(57) ABSTRACT

A multi-color writing marker may comprise a tubular marker barrel connected to a motor housing. The marker barrel may house a cartridge removably coupled to a drive shaft connected to a motor. The cartridge may include a plurality of reservoirs containing writing liquids of different colors. A marker tip may be mounted on a distal end of the cartridge. The marker tip supports a plurality of marker nibs corresponding to the number of cartridge reservoirs. Each marker nib may be is in fluid communication with a corresponding reservoir. Actuation of the motor spins the cartridge and marker nibs while a user is simultaneous creating a design on the writing surface.

20 Claims, 7 Drawing Sheets

Fig. 1
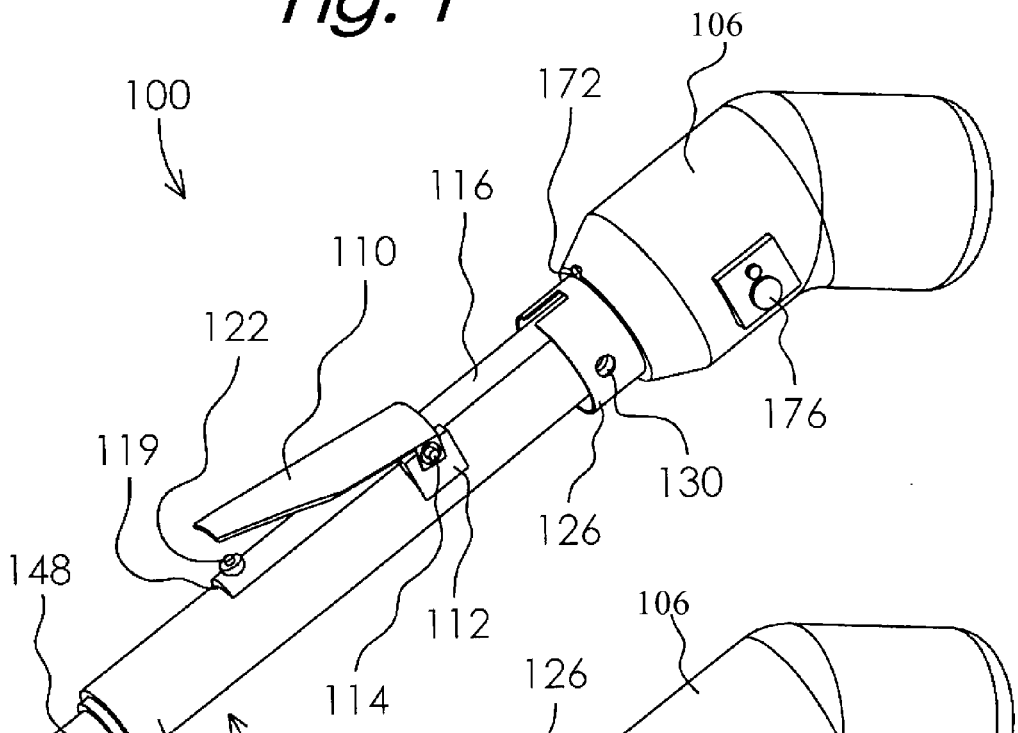
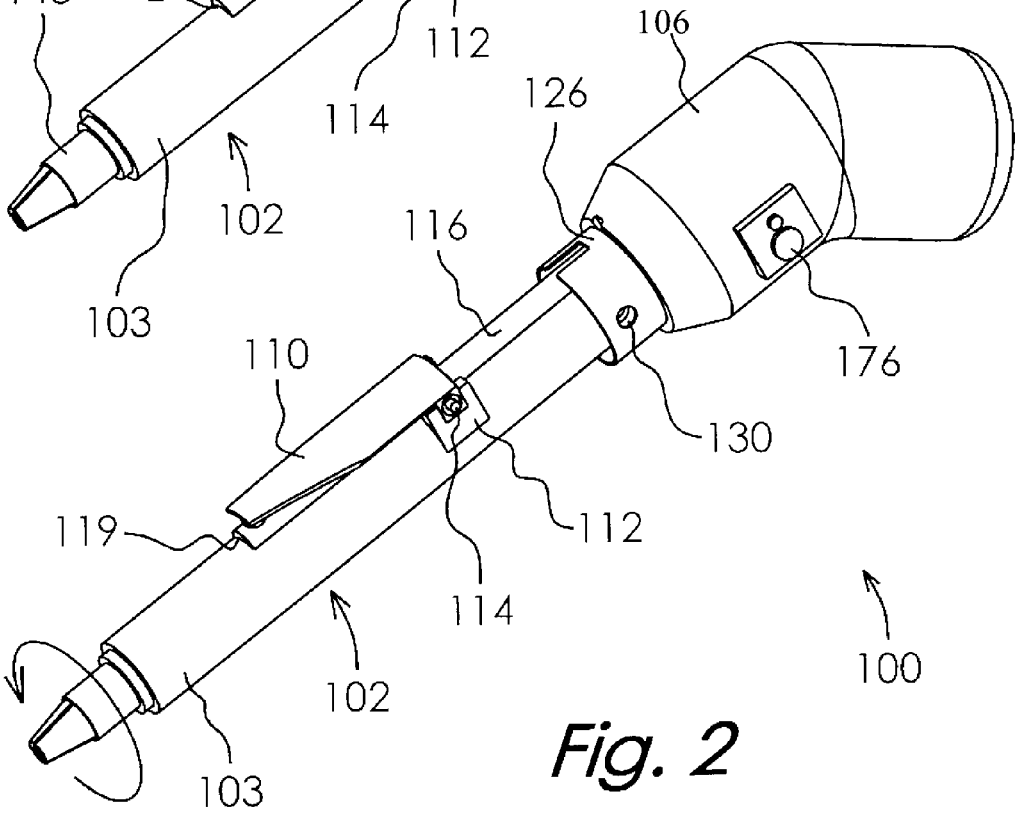
Fig. 2

Fig. 7A
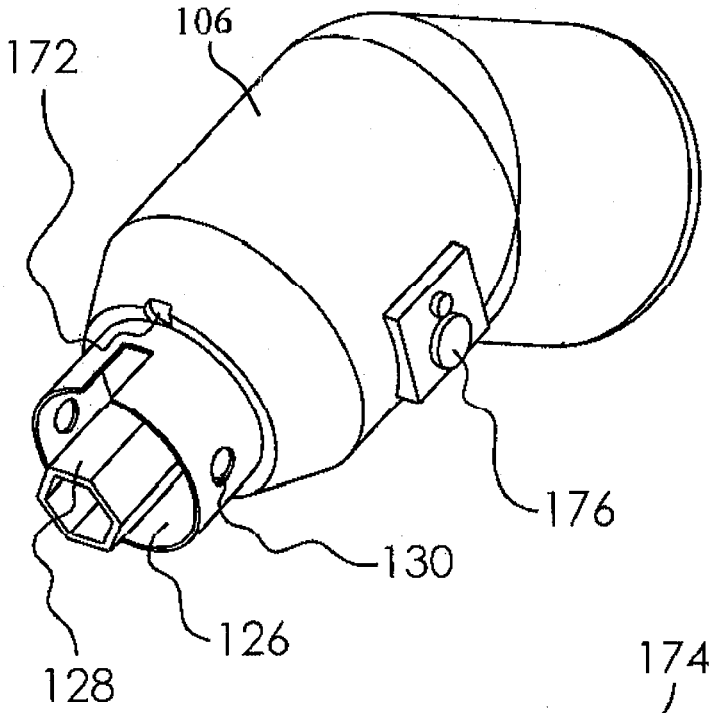
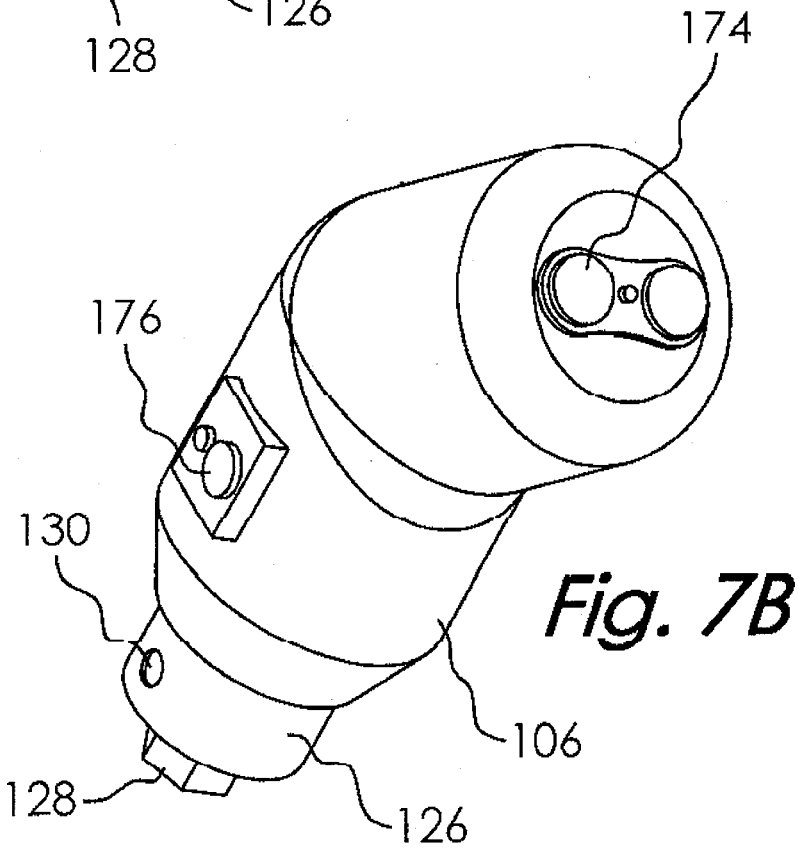
Fig. 7B

MULTI-COLOR MARKER

CROSS-REFERENCE TO RELATED APPLICATION

This application claims the benefit of U.S. Provisional Application Ser. No. 61/997,848, filed Jun. 11, 2014, which application is incorporated herein in its entirety by reference.

BACKGROUND OF THE INVENTION

The present invention relates generally to writing and painting instruments, more particularly to a marker including a multi-color ink or paint cartridge operatively connected to a motorized driver that may be selectively actuated by a user to spin the ink or paint cartridge during use.

Multi-color writing and painting instruments of the type used to write or draw on paper and the like, with different colors of ink or paint, typically include two or more nibs which simultaneously or singularly engage with the writing surface. Such multi-color writing instruments typically include a unique color of ink or paint, or a unique shade or hue of a given color that may be supplied to the writing nib. Multi-color writing instruments include, but are not limited to, writing instruments taught in U.S. Pat. Nos. 3,887,287; 4,453,849; 5,388,924; 6,953,296; 7,001,091; and 8,403,577. Such multi-color writing instruments generally include one or more writing nibs bundled proximate each other at the tip region of the writing instrument. The writing nib(s) is supplied with ink or paint of different colors stored in ink or paint reservoirs located in the writing instrument.

SUMMARY OF THE INVENTION

A multi-color writing marker may include an elongated tubular marker barrel. A motor may be fixedly secured to a distal end of the marker barrel. The marker barrel may house an ink/paint cartridge removably coupled to the motor. The ink/paint cartridge may include a plurality of ink/paint reservoirs containing different colors of ink/paint. One end of the ink/paint cartridge may be coupled to the motor and configured for removable cooperative engagement with the motor. A marker tip may be mounted or integrally formed on the opposite distal end of the ink/paint cartridge. The marker tip supports a plurality of marker nibs corresponding to the number of ink/paint reservoirs. The marker nibs are in fluid communication with a corresponding ink/paint reservoir. Manipulation of a trigger mounted on the marker barrel closes an electrical circuit supplying power to the motor for spinning the ink/paint cartridge while a user simultaneous writes and/or creates a design on a writing surface.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 1 is a perspective view of a multi-tip marker;

FIG. 2 is a second perspective of the multi-tip marker shown in FIG. 1;

FIG. 7A is a perspective view of a motor housing for a motor operatively connected to the multi-tip marker shown in FIG. 1;

FIG. 7B is another perspective view of a motor housing for a motor operatively connected to the multi-tip marker shown in FIG. 1;

DETAILED DESCRIPTION OF ILLUSTRATIVE EMBODIMENTS

Figure 3:
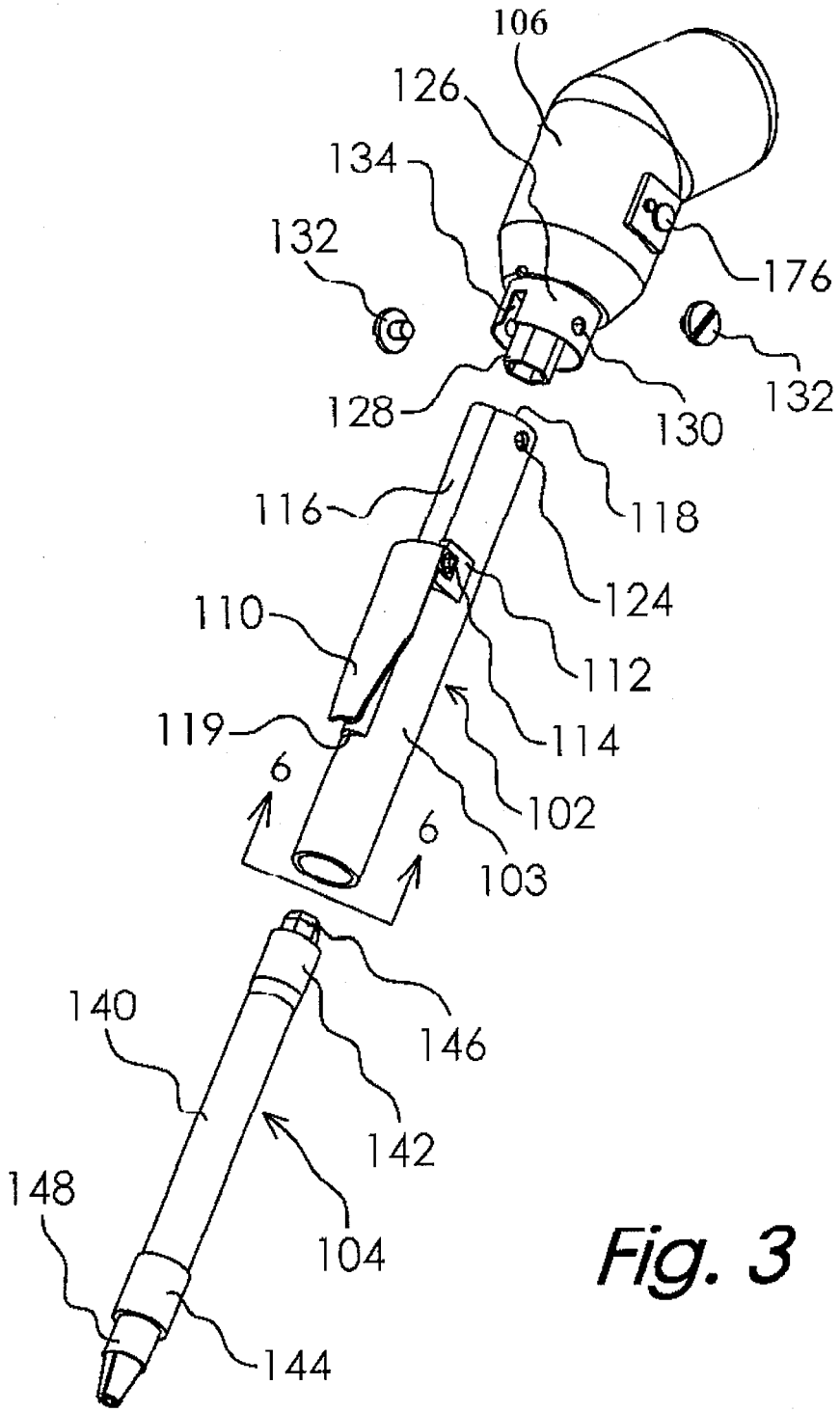
FIG. 3 is an exploded perspective of the multi-tip marker shown in FIG. 1.

Referring first to FIG. 1, a multi-color marker is generally identified by the reference numeral 100. The marker 100 may include a marker barrel 102 that is connected to a motor housing 106. The marker barrel 102 may be secured to the motor housing 106 with one or more screws or similar connector means, more clearly shown in the exploded view of FIG. 3. A cartridge 104 may be housed within the marker barrel 102. The cartridge 104 may be operatively connected to a motor fixedly mounted within the motor housing 106.

The marker barrel 102 may comprise an elongated tubular body 103 having an axial passage 105 extending threre-through. The tubular body 103 is open at both distal ends. Lobes 112 may be fixedly secured to the tubular body 103 by welding and the like or alternatively may be integrally formed with the marker barrel 102. The lobes 112 are fixed to the marker barrel 102 in spaced facing relationship relative to one another. Bearing pins 114 extend outwardly from the lobes 112. The bearing pins 114 are oriented substantially perpendicular to the lobes 112 and may be welded thereto or integrally formed with the lobes 112.

An actuating lever or trigger 110 may be mounted on the marker barrel 102. A distal end of the trigger 110 may be provided with downwardly extending tabs 113 which are in spaced facing relationship relative to one another. Holes 111 extending through the tabs 113 may be sized to receive the bearing pins 114 fixed to the lobes 112 for pivotally connecting the trigger 110 to the marker barrel 102.

Referring now to FIG. 3, the marker barrel 102 may include a longitudinal raised portion or ridge 116 on the external surface thereof. The ridge 116 may extend from an end 118 of the marker barrel 102 and terminate at a distal end 119 of the ridge 116 proximate the end 121 of the marker barrel 102. The ridge 116 may include a conduit 120 extending from the end 118 of the marker barrel 102 to the closed end 119 of the ridge 116. An electrical switch 122 may be fixedly secured proximate the closed end 119 of the ridge 116. The switch 122 may extend through and project above the ridge 116. Electrical wires extending through the conduit 120 connect the switch 122 to the motor mounted in the motor housing 106 to form a normally open electrical circuit.

Figures 5, 6:
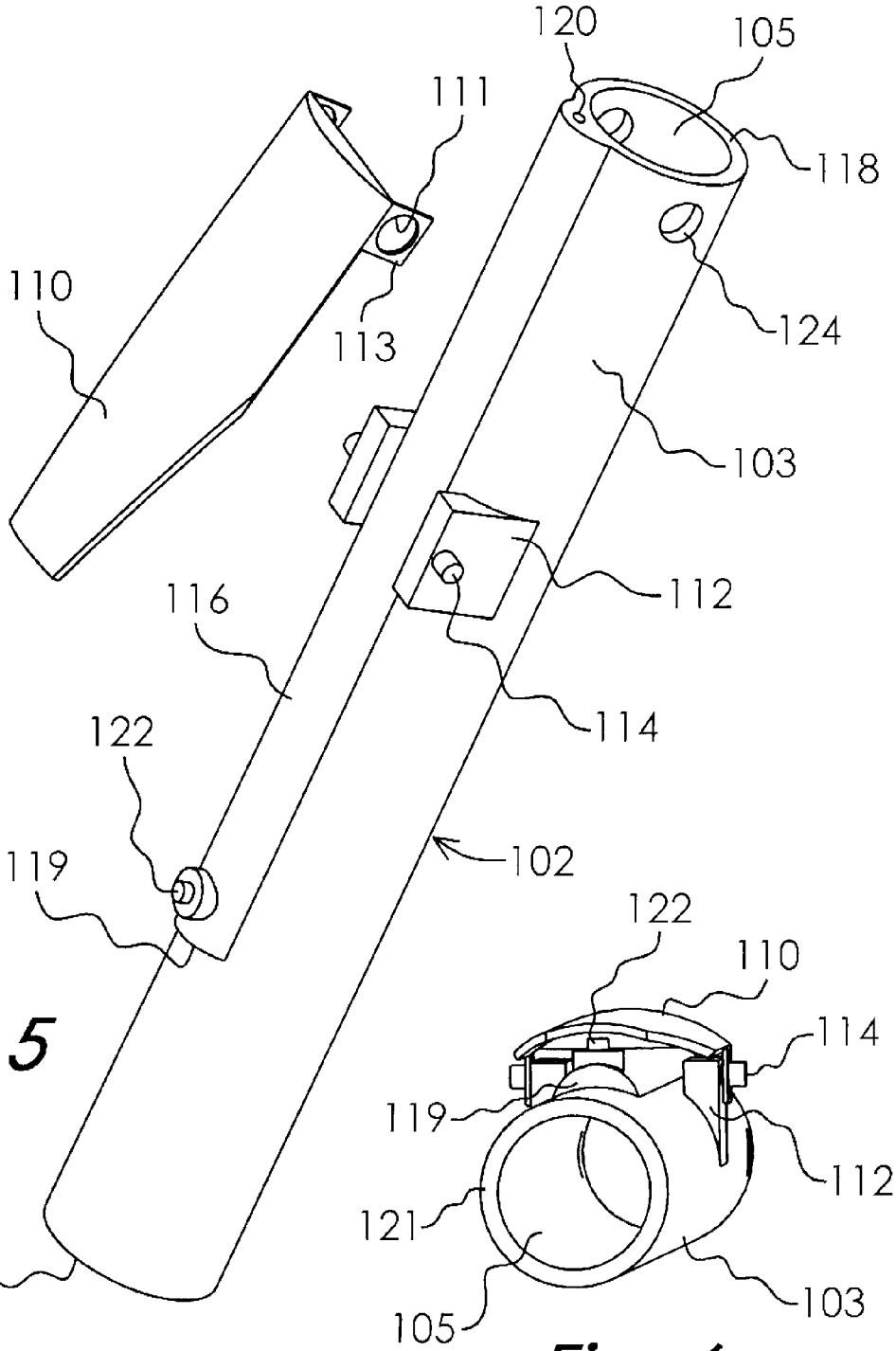
FIG. 5 is an exploded perspective view of the barrel of the multi-tip marker shown in FIG. 1.
FIG. 6 is a perspective view of the barrel of the multi-tip marker taken along line 6-6 in FIG. 3.

Referring still to FIG. 3, the marker barrel 102 may be provided with threaded holes 124 proximate its distal end 118. The holes 124 are on opposite sides of the marker barrel 102, aligned in spaced relationship relative to one another, as best shown in FIG. 5. A substantially cylindrical collar 126 may be fixedly secured to the motor housing 106. The collar 126 is concentric with a drive shaft 128 connected to the motor mounted in the motor housing 106 in a manner known in the art. The collar 126 may include aligned holes 130 on opposite sides thereof in spaced relationship relative to one another. The marker barrel 102 may be connected to the motor housing 106 by inserting the end 118 of the marker barrel 102 into the annular space between the collar 126 and the drive shaft 128, and aligning the threaded holes 124 in the marker barrel 102 with the holes 130 in the collar 126. Screws 132 installed through the holes 130 and tightened into the threaded holes 124 fixedly secure the marker barrel 102 to the motor housing 106. An axial slot 134 may extend from the front edge of the collar 126 toward the rear region thereof. The slot 134 may be sized and configured to receive a forward portion of the ridge 116 to form a fixed keyed connection between the marker barrel 102 and the collar 126, and to facilitate alignment of the holes 124 and 130 for convenient threaded connection of the screws 132 in the threaded holes 124.

Referring now to FIGS. 4A-4D, the cartridge 104 may be sized and configured to fit within the marker barrel 102. The cartridge 104 may include a substantially cylindrical body 140. The body 140 includes opposite distal ends 142, 144 having an outer diameter greater than the outer diameter of the intermediate portion 143 of the body 140. The enlarged distal ends 142, 144 of the cartridge 104 may be manufactured to very high tolerances to prevent sticking or wobble of the cartridge 104 with minimal friction as it spins within the marker barrel 102. The cartridge 104 may include a hex boss 146 projecting from its upper distal end 143 and a marker tip 148 fixed to the lower distal end 145 of the cartridge 104.

Figure 4A:
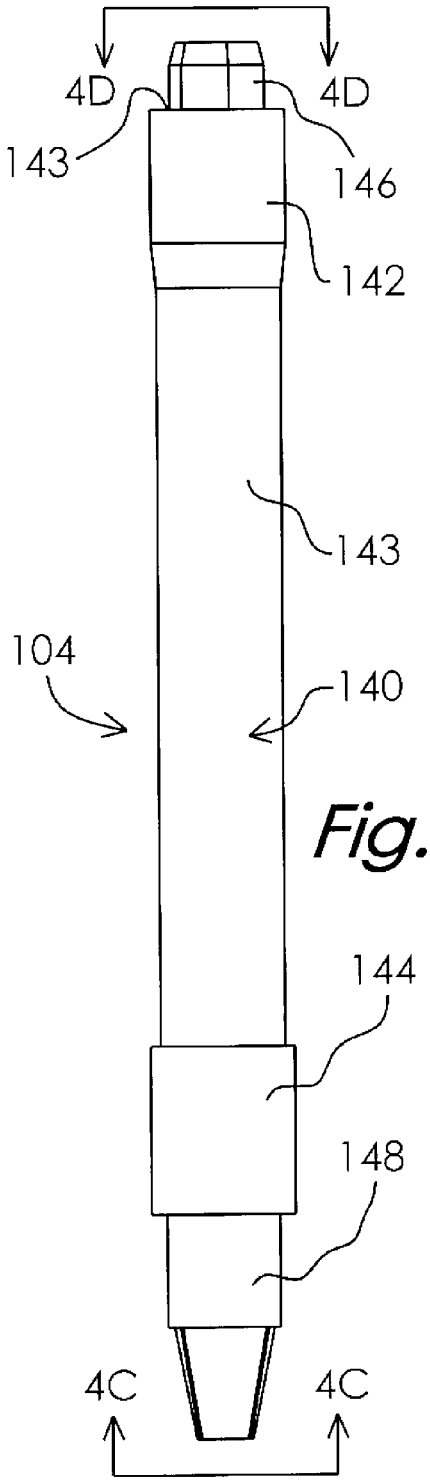
FIG. 4A is a side view of a cartridge housed within a marker barrel of the multi-tip marker shown in FIG. 1.
Figure 4B:
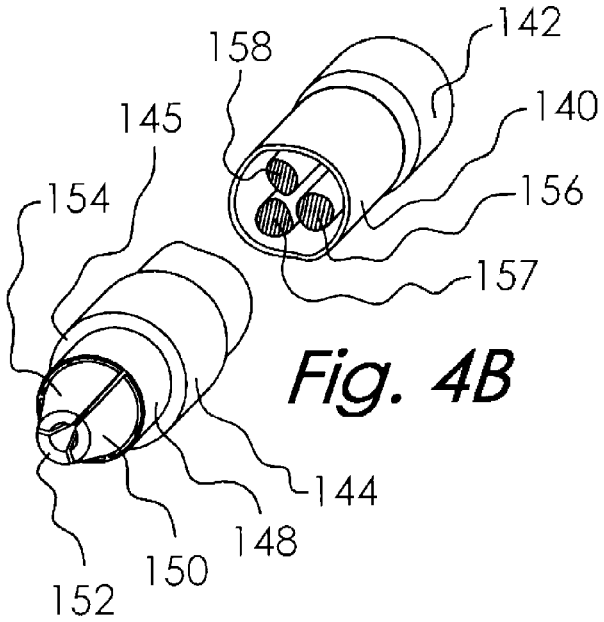
FIG. 4B is a partial cutaway perspective view of the cartridge shown in FIG. 4A.
Figure 4D:
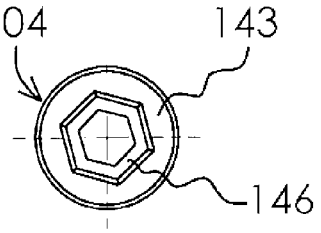
FIG. 4D is a top plan view of the ink/paint cartridge taken along line 4D-4D in FIG. 4A.
Figure 4C:
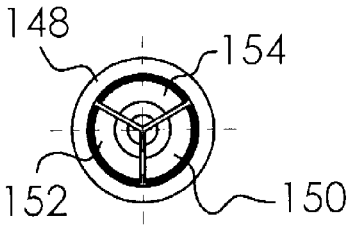
FIG. 4C is a bottom plan view of the cartridge taken along line 4C-4C in FIG. 4A.

The marker tip 148 may support two or more writing nibs. For example, FIG. 4B shows a tip 148 supporting three nibs 150, 152 and 154. The distal ends of the nibs 150, 152, 154 may lie in substantially the same plane, which plane is perpendicular to the rotational axis of the cartridge 104. The nibs 150, 152, 154 illustrated in FIG. 4B may be constructed of felt or any other material suitable for delivering a writing fluid, such as ink, to the tips of the nibs 150, 152, 154 through capillary action and the like. Ink for the nibs 150, 152, 154 is supplied from reservoirs 156, 157, 158 housed within the cartridge 104. Each reservoir 156, 157, 158 may comprise a tubular plastic shell containing a medium saturated with ink or other writing liquid, such as a sponge material and the like. Alternatively, the reservoirs 156, 157, 158 may comprise sealed tubes filed with liquid ink, pigmented liquid or paste and the like. A detachable cap (not shown in the drawings) may be provided to cover the nips of the marker 100 when it is not in use.

In another alternate embodiment, the cartridge 104 may be fabricated by an extrusion process that partitions the interior of the body 140 of the cartridge 104 into two or more liquid-tight chambers. Different colors of writing liquids, such as ink, writing paint and the like, may thus be isolated by the extruded partition walls 160, best shown in FIG. 8, so that the writing liquid colors do not mix. In such an embodiment, plastic shell and/or sealed tube reservoirs would not be necessary. The partition walls 160 may extend to the marker tip 148 and the distal ends of the partition walls 160 may taper inwardly toward the distal end of the writing nibs to prevent the nibs 150,152,154 from contacting each other. The nibs 150, 152,154 may be in fluid communication with a respective reservoir 156, 157, 158 and may be frictionally retained between the partition walls 160. In addition or in the alternative, glue or a layer of an adhesive may be applied to the surface of the tapered ends of the partition walls 160 to fixedly secure the nibs 150, 152, 154 in the marker tip 148.

Referring now to FIGS. 7A and 7B, two perspective views show the motor housing 106 of the multi-color marker 100 in greater detail. The motor housing 106 may securely house a motor operatively connected to the drive shaft 128. An end of the drive shaft 128 concentric with the collar 126 may extend out from the motor housing 106. Wires connected to the electrical switch 122 may be routed to the motor through an opening 172 in the motor housing 106. Male and female electrical plugs may be provided for convenience of assembly. The motor may be battery powered. Batteries housed in the motor housing 106 may be accessed by removal of a battery cover 174. A master switch 176 electrically connected to the motor may be mounted on the motor housing 106. Moving the switch 176 from the "off" position to the "on" position places the motor in standby mode.

The drive shaft 128 may be configured to engage and couple with the boss 146 on the cartridge 104. In the embodiments described herein, by way of illustration only, and not by way of limitation, a male hex boss 146 on the cartridge 104 may be received into the female hex profile of the drive shaft 128 whereby frictional engagement of mating surfaces forms a rigid friction joint connecting the cartridge 104 to the drive shaft 128. Upon actuation of the motor mounted in the motor housing 106, a torque force transmitted to the drive shaft 128 spins the cartridge 104 and by extension the marker nibs. It is understood, however, that splines and other polygonal coupling shapes may be used to releasably couple the cartridge 104 to the drive shaft 128. Other alternative means, for example, wedge shaped means, snap means, notch means, o-ring distortion means, spring detent means, cylindrically tapered means, and the like may be suitable coupling means for transmitting a torque force to the cartridge 104 and enable rapid and easy coupling and decoupling of the cartridge 104 with the drive shaft 128.

Figure 8:
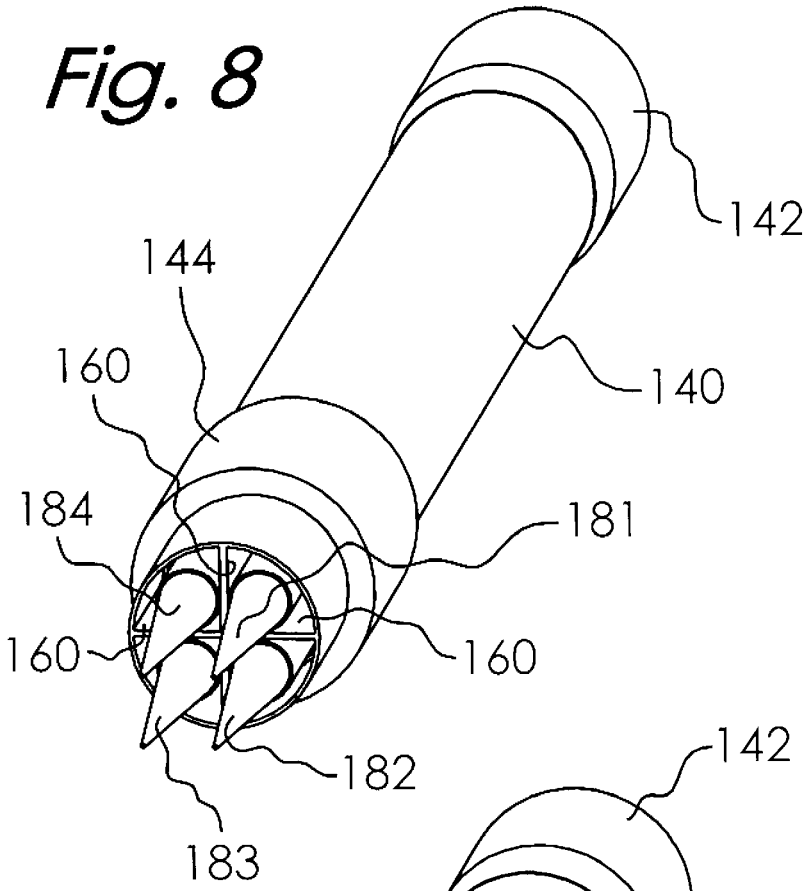
FIG. 8 is perspective view illustrating brush writing nibs fixed to the cartridge shown in FIG. 4A.
Figure 9:
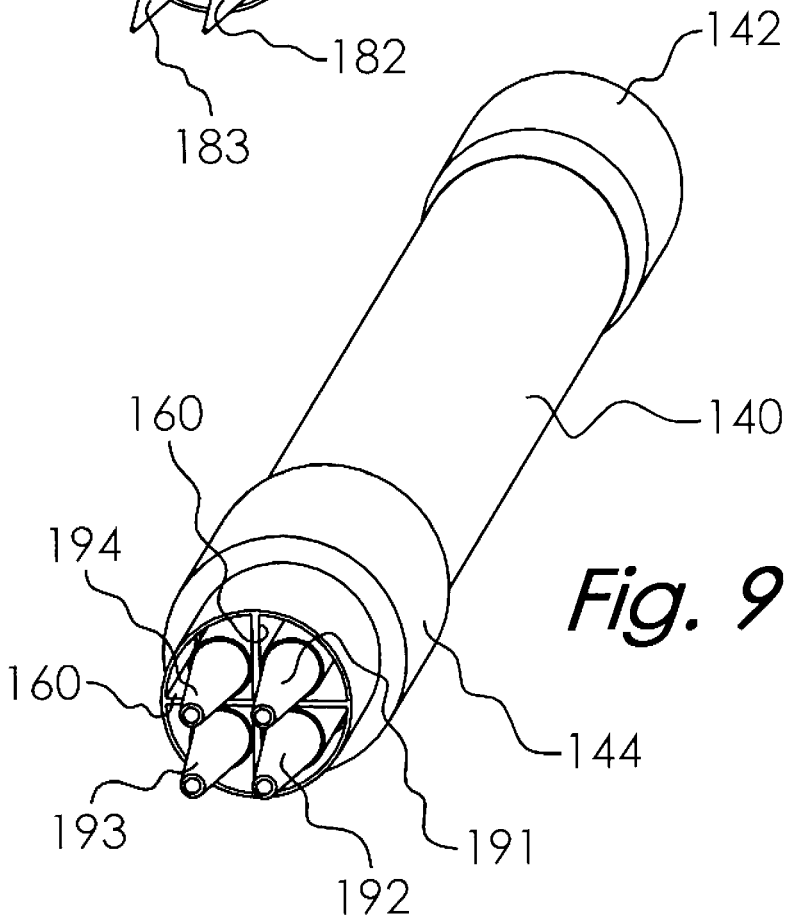
FIG. 9 is perspective view illustrating ball point or roller writing nibs fixed to the cartridge shown in FIG. 4A.

Referring now to FIGS. 8 and 9, alternative nib configurations are shown. In FIG. 8, the cartridge 104 may include brush nips 181, 182, 183 and 184 separated by partition walls 160. The brush nips 181, 182, 183, 184 may, for example, comprise coarsely extruded nylon trimmed to a conical shape. The reservoirs, which may be filled with different colored inks, are isolated from each other by the partition walls 160 to prevent the ink colors from mixing with each other. In FIG. 9, the cartridge 104 may include ball point and/or rolling writer nips 191, 192, 193 and 194.

The trigger 110 may provide fingertip motor control to conveniently actuate the motor and spin the cartridge 104 and writing nibs supported by the tip 148 while a user is drawing. Manipulation of the trigger 110 to engage the electrical switch 122 may turn the spinning action on or off and/or vary the speed and/or rotational direction of the tip 148. Solid lines of a single ink color may be drawn while the motor is off or in the idle mode, and lines of multiple colors from the multiple marker nibs may be drawn while the motor is powered to spin the cartridge 104. Variation of the tip 148 rotational speed may increase or decrease the length of the multi-color lines, and may change the distribution density of the multi-color lines. Also, greater variations in written patterns may be achieved by varying the rotational speed of the tip 148 while a user moves the multi-color marker 100 relative to the writing surface.

Figure 10:
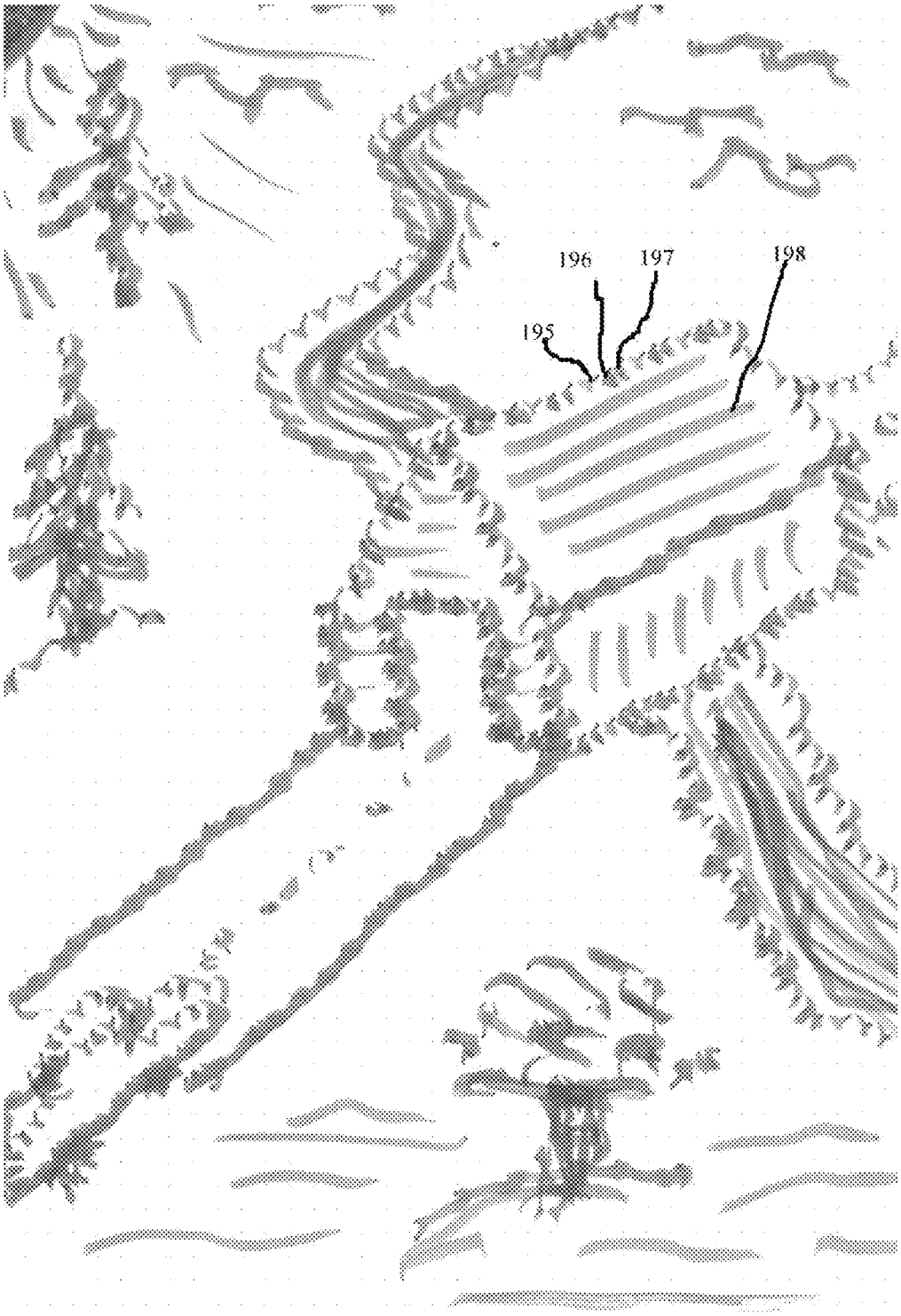
FIG. 10 is an illustration of a sketch created with the multi-color marker shown in FIG. 1.

Referring now to FIG. 10, the illustrated sketch was drawn utilizing a marker having a multi-color cartridge 104 installed. Three colors 195, 196, 197 and broad felt nibs were used to create the sketch. Straight lines 198 were drawn while the marker 100 was off or in the idle mode. The cartridges 104 are easily interchangeable so that a user may have multiple cartridges 104 available that are filled with a wide range of ink colors or different shades of a single color to create relatively complex sketches.

While a preferred embodiment of the invention has been shown and described, other and further embodiments of the invention may be devised without departing from the basic scope thereof, and the scope thereof is determined by the claims which follow.

The invention claimed is:

1. A multi-color writing and painting marker, comprising:

a) a marker barrel defining an elongated tubular body;

b) a removable cartridge configured for receipt in said marker barrel, said cartridge including a plurality of reservoirs containing different colors of writing fluid, a marker tip mounted on a distal end of said cartridge, said marker tip supporting a plurality of marker nibs in fluid communication with said reservoirs; and c) a motor housed within a motor housing operatively connected to said cartridge and operable to spin said cartridge by manipulation of a trigger pivotally mounted on said marker.

2. The marker of claim 1 wherein said trigger is pivotally connected to said marker barrel for manipulation by a user to close an electrical circuit to actuate said motor.

3. The marker of claim 1 including an on-off switch operatively connected to said motor, wherein said on-off switch is movable from an off position to an on position placing said motor in an idle mode.

4. The marker of claim 1 wherein said cartridge includes a distal end configured for releasably coupling said cartridge to said drive shaft.

5. The marker of claim 2 wherein said marker barrel includes a longitudinal ridge on an outer surface of said tubular body, said ridge providing a passageway for electrical wiring connecting said motor to an electrical circuit.

6. The marker of claim 5 including an electrical switch engageable by said trigger to actuate said motor.

7. The marker of claim 1 wherein said cartridge includes an interior chamber partitioned to form a plurality of liquid-tight compartments.

8. The marker of claim 1 wherein said cartridge is interchangeable with one or more cartridges filled with different color sets of writing fluid.

9. The marker of claim 1 wherein said writing fluid is ink.

10. The marker of claim 1 wherein said writing fluid is a pigmented liquid or paste.

11. The marker of claim 1 wherein said writing fluid is writing paint.

12. The marker of claim 4 including a boss extending axially from a distal end of said cartridge, said boss configured for frictional mating engagement with said drive shaft of said motor.

13. The marker of claim 1 wherein said motor housing includes a mounting collar concentric with said drive shaft releasably connecting said marker barrel to said motor housing.

14. A multi-color marker, comprising:

a) a marker barrel defining an elongated tubular body;

b) a cartridge concentrically housed within said tubular body, said cartridge including a plurality of marker nibs secured to a first distal end of said cartridge;

c) a motor housed within a motor housing secured to a distal end of said tubular body, said motor including a drive shaft releasably connecting said cartridge to said motor;

d) a trigger mounted on said marker barrel for selectively engaging an electrical switch in an electric circuit connected to said motor; and e) wherein a torque force applied to said drive shaft spins said cartridge and said marker nibs about the longitudinal axis of said marker barrel.

15. The marker of claim 14 wherein said trigger is pivotally connected to said marker barrel for manipulation by a user to close the electrical circuit to actuate said motor.

16. The marker of claim 14 including a thumb switch operatively connected to said motor, wherein said thumb switch is movable from a first position to a second position to place said motor in an idle mode.

17. The marker of claim 14 wherein said cartridge includes an interior chamber partitioned to form a plurality of liquid-tight compartments containing ink of different colors, wherein each said marker nibs is in fluid communication with a respective one of said compartments.

18. The marker of claim 14 including a plurality of sealed receptacles housed within said cartridge, said receptacles containing writing paint of different colors, wherein each said marker nibs is in fluid communication with a respective one of said receptacles.

19. The marker of claim 14 wherein said cartridge includes a second distal end configured for releasably coupling said cartridge to said drive shaft, and wherein said cartridge is interchangeable with one or more cartridges filled with different color sets of writing ink.

20. The marker of claim 14 wherein said marker nips include coarsely extruded nylon.

* * * * *